US005320720A

United States Patent [19]

Hayden et al.

[11] Patent Number: 5,320,720

[45] Date of Patent: Jun. 14, 1994

[54] EXTRACTION OF PRECISOUS METALS FROM ORES THEREOF

[75] Inventors: Alfred S. Hayden, Richmond Hill; Christopher A. Fleming, Peterborough; Chandulal P. Patel, West Vancouver, all of Canada

[73] Assignee: Prime Resources Group Inc., Vancouver, Canada

[21] Appl. No.: 739

[22] Filed: Jan. 5, 1993

[51] Int. Cl.[5] ..... C25C 1/00

[52] U.S. Cl. ..... 204/110; 423/25; 423/27; 423/29; 423/33

[58] Field of Search ..... 204/110; 423/25, 27, 423/29, 33

[56] References Cited

U.S. PATENT DOCUMENTS

| | | | |
|---|---|---|---|
| T104,001 | 3/1984 | Kunter et al. | 75/118 |
| 2,777,764 | 1/1957 | Hedley et al. | 75/110 |
| 2,810,638 | 10/1957 | Hazen | 75/107 |
| 4,188,208 | 2/1980 | Guay | 423/25 |
| 4,289,532 | 9/1981 | Matson et al. | 423/25 |
| 4,571,263 | 2/1986 | Weir et al. | 75/101 |
| 4,578,163 | 3/1986 | Kunter et al. | 204/110 |
| 4,610,724 | 9/1986 | Weir et al. | 204/105 |

*Primary Examiner*—John Niebling
*Assistant Examiner*—Patrick J. Igoe
*Attorney, Agent, or Firm*—Ridout & Maybee

[57] ABSTRACT

Increased efficiency of extraction of silver and gold from ore materials thereof containing active carbonaceous material is obtained by conducting the extraction in two stages. In a first stage a portion of the silver and of the gold when present is extracted in a cyanide leach solution. The leached solids residue is contacted with activated carbon so that the silver and the gold when present are adsorbed on the activated carbon at elevated temperature (most preferably at about 35° C. to about 100° C.). In a modification, a slurry of the ore material is treated with cyanide and the precious metal adsorbed directly from the cyanided slurry with activated carbon at elevated temperature up to about 70° C.

10 Claims, 1 Drawing Sheet

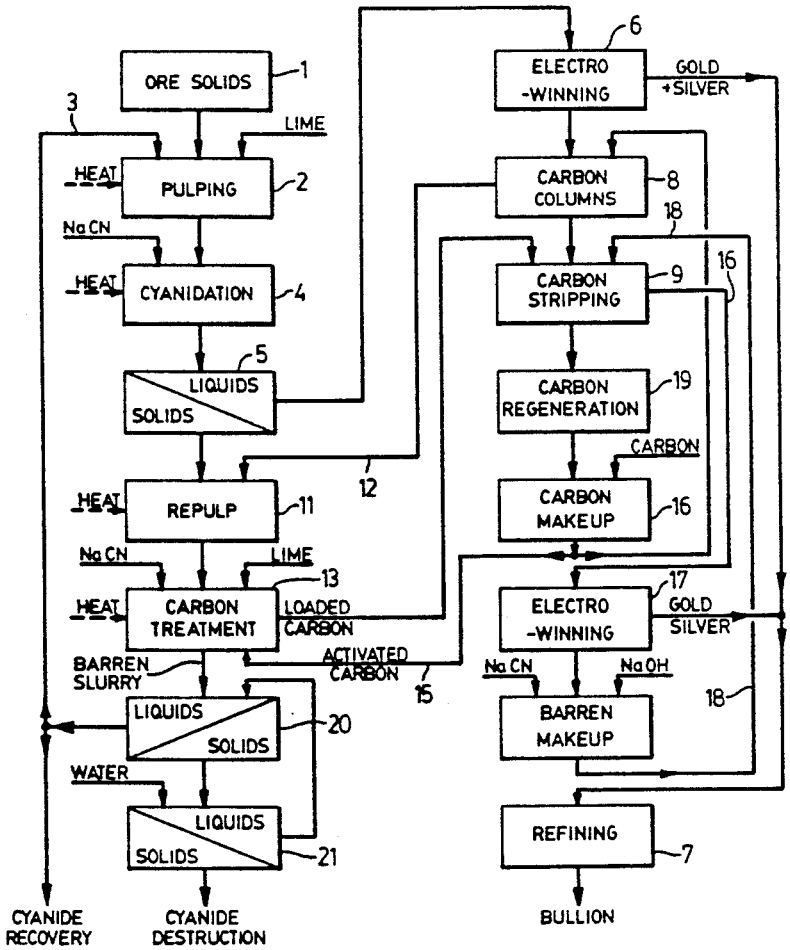

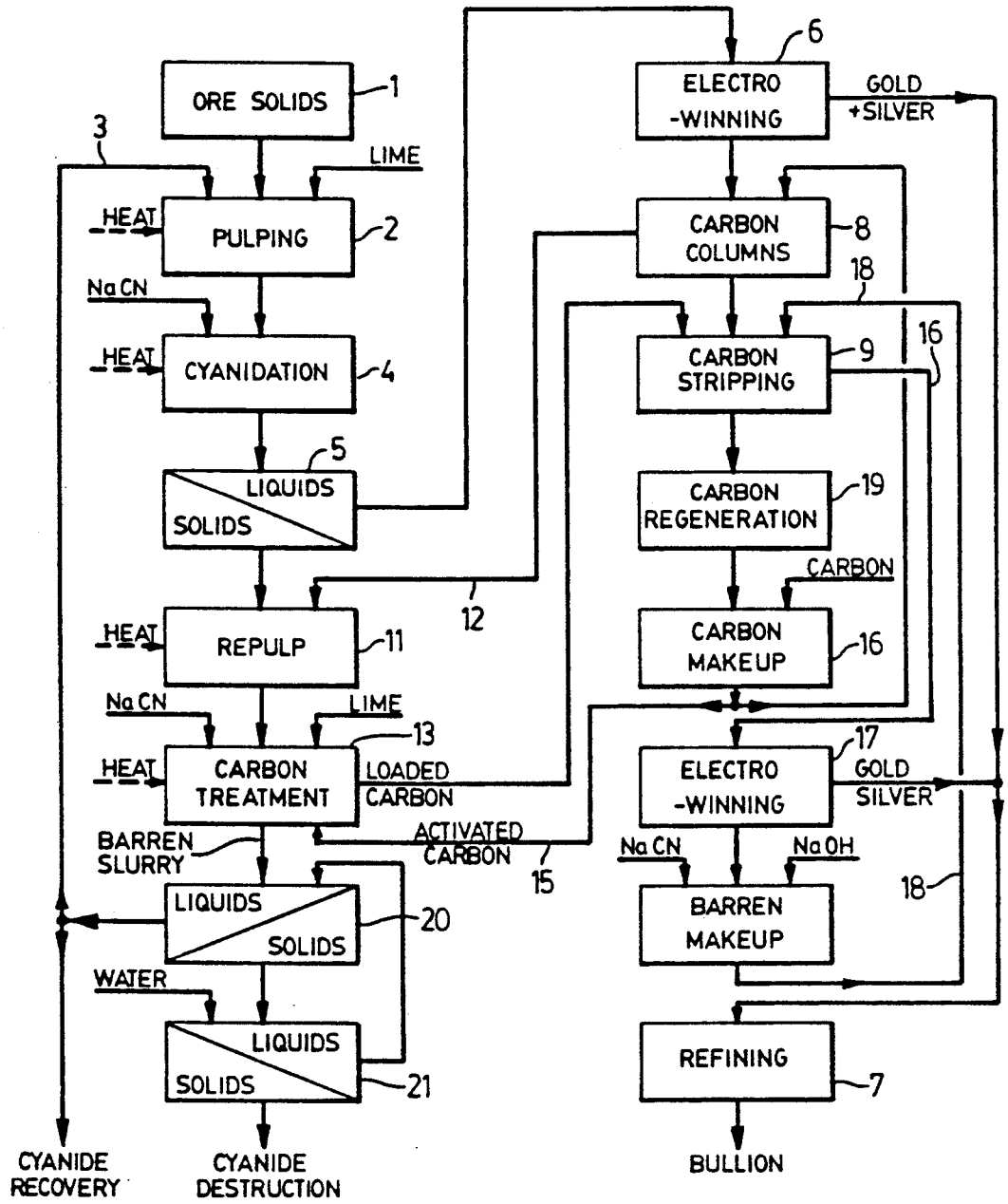
ORE SOLIDS
1
3
LIME
HEAT
PULPING
2
Na CN
HEAT
CYANIDATION
4
5
LIQUIDS
SOLIDS
HEAT
REPULP
11
12
Na CN
LIME
13
HEAT
CARBON TREATMENT
LOADED CARBON
BARREN SLURRY
ACTIVATED CARBON
15
LIQUIDS
SOLIDS
20
WATER
LIQUIDS
SOLIDS
21
CYANIDE RECOVERY
CYANIDE DESTRUCTION
6
ELECTRO -WINNING
GOLD +SILVER
CARBON COLUMNS
8
18
CARBON STRIPPING
9
16
CARBON REGENERATION
19
CARBON
CARBON MAKEUP
16
17
ELECTRO -WINNING
GOLD SILVER
Na CN
Na OH
BARREN MAKEUP
18
REFINING
7
BULLION

EXTRACTION OF PRECISOUS METALS FROM ORES THEREOF

The widely practised cyanidation process for extracting gold and silver from their ores requires contacting the rock solids, usually after grinding the rock to a fine size, with a solution containing cyanide ions. In the presence of oxygen, generally supplied by air, gold and silver dissolve into the solution as their respective cyanide compounds. In most modern operations, the gold and accompanying silver are recovered from the solution by adsorbing the metals onto activated carbon. The loaded carbon is screened from the ore slurry and is processed to strip the precious metals. The stripped carbon is usually directed back to the carbon adsorption circuit to complete the cycle. This process is referred to as carbon-in-pulp (CIP).

Some precious metal ores contain naturally occurring active carbonaceous material which cannot be readily removed. When such ores are cyanide leached, much of the solubilized gold and silver is adsorbed by this material and is lost from the solution. This action is termed "preg robbing". The naturally occurring carbonaceous material may be organic in character or it may be inorganic, for example in the form of graphite. The problem of loss of gold and silver to the naturally occurring carbonaceous material through preg robbing can be especially acute when the ore contains substantial quantities of inorganic carbon or graphite. In order to overcome this problem, activated carbon has been added directly to the cyanide leach, capturing gold and silver as it passes into solution. The loaded carbon is screened from the pulp and is processed as in CIP. This system is referred to as carbon-in-leach (CIL).

CIP processing is described in, for example, Kunter et al U.S. Pat. No. 4,578,163 dated Mar. 25, 1986, the disclosures of which are incorporated herein by reference. CIL processing is described in, for example, Guay U.S. Pat. No. 4,188,208 dated Feb. 12, 1980, and in Weir et al U.S. Pat. Nos. 4,571,263 dated Feb. 18, 1986 and 4,610,724 dated Sep. 9, 1986, the disclosures of all of which are incorporated herein by reference. The distinction between the two processes is chiefly that, with CIL, the activated carbon is present in contact with the ore solids to be extracted at the time the solids are contacted with cyanide. Higher recoveries tend to be achieved with CIL in the case in which the solids contains naturally occurring active carbonaceous material which may tend to capture silver and gold values. However, CIL is subject to the disadvantage that the ore solids are in contact with the carbon for a longer time, increasing the carbon retention time and thus the inventory of precious metals.

Because of the large amount of carbon to be processed, the above processes are less applicable to silver ores or to gold and silver ores containing substantial silver values and which contain naturally occurring carbonaceous material.

Recovery of precious metals from solution may also be effected by cementation with zinc using the well known Merrill-Crowe process. This process is normally applied only to low tonnage, high gold content ores or when the feed contains substantial silver values.

In commercial applications of the above processes known to the inventors, the processes are conducted without the deliberate addition of heat.

In one aspect, the present invention provides a process for recovery of precious metal, wherein said precious metal is selected from the group consisting of silver and a mixture of gold and silver, from an ore material of said precious metal containing naturally occurring carbonaceous material, comprising leaching said ore material by forming a slurry of the ore material in cyanide solution and dissolving a portion of said precious metal as cyanide compounds thereof in said solution, conducting a solids-liquids separation on the slurry to separate a solution containing said portion of said precious metal from a leached solids residue containing the remainder of said precious metal, forming a slurry of said leached solids residue in a liquid compatible therewith, mixing activated carbon therewith and maintaining the mixture at elevated temperature whereby a substantial portion of the remainder of said precious metal is captured on said activated carbon, separating said activated carbon having said precious metal thereon from said second slurry and stripping said activated carbon to liberate the precious metal captured thereon.

The liquid employed for forming the slurry of leached solids may be any liquid that is compatible with the solids residue and that does not interfere with capture of precious metals on the activated carbon. For example it may be water, or a barren liquid obtained from a later stage of the process. Preferably, the liquid is an aqueous cyanide solution.

The above aspect of the invention serves to greatly reduce the quantity of activated carbon required for the capture of the precious metal values. The reduction is represented by the amount that would have been required for adsorption of the said portion of the precious metal, contained in the solution that is separated at the above-mentioned solids-liquids separation step.

This reduction in the utilisation of activated carbon significantly improves the economy of the process. The smaller the utilisation of carbon, the smaller need be the activated carbon treatment plant, since normally it is desirable to reactivate and recycle the activated carbon after stripping. Hence, the costs of activated carbon inventory and of construction and operation of the processing plant are considerably reduced.

As noted above, in the present process the adsorption of precious metal onto the activated carbon from cyanide leached ore solids is conducted at elevated temperature. Surprisingly, it has been found that, at least when the adsorption is conducted for a period such that substantial equilibrium is achieved, the absolute quantity of precious metal adsorbed onto the activated carbon increases markedly at elevated temperature. Preferably, the adsorption step is conducted at a temperature from about 35° C. up to the temperature at which the reactants commence decomposition. Recoveries have been found to increase with increasing temperatures above about 35° C.

However, higher temperatures increase the energy costs associated with the process, and temperatures above 100° C. require pressurization of the apparatus. It is considered that increased temperatures above 100° C. do not improve the recoveries sufficiently to justify the added costs of pressurization, and therefore temperatures about 35° C. to less than about 100° C. are desirable. More preferably, the temperature is in the range about 35° C. to about 100° C., still more preferably about 50° C. to about 100° C.

In a further aspect, the present invention provides a process for recovery of precious metal, wherein said precious metal is selected from the group consisting of gold, silver and mixtures thereof, from an ore material of said precious metal containing naturally occurring active carbonaceous material, comprising reacting the ore material with cyanide solution to provide a slurry containing the precious metal in solubilized form, mixing activated carbon with said slurry maintained at elevated temperature up to about 70° C. and capturing said precious metal by adsorption on the activated carbon, separating the activated carbon from the slurry and stripping the separated activated carbon to liberate precious metal therefrom.

This aspect of the present invention is especially advantageous when applied to ores which do not have high contents of precious metal such as silver and which do not therefore demand the addition of large quantities of activated carbon. As indicated above, at elevated temperature, at least when equilibrium is substantially achieved, significantly increased capture of precious metal onto the activated carbon has been found surprisingly to be obtained. Preferably the temperature of treatment with the activated carbon is 40° C. to about 70° C., more preferably about 50° C. to about 70° C.

In the present invention, the slurry with which the activated carbon is mixed is preferably maintained at a pH of about 9 to about 11, more preferably about 10.5 to about 11.

The liquid phase of the slurry with which the activated carbon is mixed preferably contains some cyanide ion. The cyanide ion is usually derived from sodium cyanide but the cyanides such as potassium cyanide may of course be employed as is well understood by those skilled in the art. It is convenient to calculate the cyanide ion concentration as the equivalent concentration of sodium cyanide. Preferably the concentration is the equivalent of up to about 3.0 g/L sodium cyanide, based on the volume of the solution.

The present process may be applied with advantage to recovery of gold and silver from the finely divided oxidized residue obtained from the aqueous oxidation process described in co-pending application No. 07/885,761 filed May 20, 1992 in the name Chandulal P. Patel and Alfred S. Hayden, and assigned to the assignee of the present application. The said application No. 07/885,761 filed May 20, 1992 is hereby incorporated by reference herein. It will, however, be appreciated that the process may be applied to recovery from like ores of silver or of gold or of silver and gold and which may contain naturally occurring carbonaceous material.

The accompanying single figure of drawings shows, by way of example, a flow sheet illustrating one form of the present invention.

The ore material to be treated may be in the form of an ore or in the form of a concentrate obtained by processing an ore to reduce or eliminate gangue materials. As noted above, the starting material ore may with particular advantage be the residue obtained from aqueous oxidation of a refractory silver, gold or silver and gold ore material, for example as described in the above mentioned application Ser. No. 07/885,761 filed May 20, 1992 in the name Patel and Hayden.

However, the process can be conducted with advantage to recover silver or gold from any ore thereof with a content of naturally occurring active carbonaceous material. In one advantageous form, the ore is a high grade silver ore or is a gold ore with a high content of silver. Typically, the ore contains more than about 800 g/t silver. The ore materials to which the invention is most advantageously applied contain a quantity of naturally occurring active carbon, such that significant absorption of precious metal by the active carbon occurs. In this example the amount of naturally occurring active carbon is about 1 to about 1.5%.

Usually, the slurry material or solids are in finely divided form as a result of crushing and grinding operations and other pre-treatment such as aqueous oxidation which may have been carried out on a starting material ore or concentrate. Typically, the starting material solids are at least about 80% less than 200 mesh.

In the example illustrated, the feed of ore solids 1 is formed into a slurry or pulp at 2 by addition of barren liquid taken along a line 3 from a later stage of the process. Sufficient barren liquid is added to form a slurry of desired consistency and flowability so that it can be readily flowed through subsequent stages. Preferably the solids content is about 25% to 45% based on the total weight of the slurry.

Before cyanidation, a base, preferably in the form of lime (CaO or $Ca(OH)_2$) is added to bring the pulp to a pH appropriate for the cyanidation step (preferably about pH 10.5 to 11). The alkaline slurry is then subjected to cyanidation at stage 4, wherein a water soluble cyanide, usually sodium cyanide, is added. Preferably, the cyanide solution is maintained in contact with the ore solids for a period, for example about 24 hours, sufficient for equilibrium to be substantially achieved between the ore solids and the solution, and agitation is applied to the mixture in any conventional manner. In the presence of oxygen, usually supplied by the ambient air, a portion of the silver, and of the gold when present in the ore solids, dissolve in the aqueous phase in the conventional manner. The precious metals form the well-known cyanide complexes. However, a substantial proportion of the gold and silver remain associated with the solids and may, for example, be captured by indigenous carbon present in the ore material. For example, about 90% of the silver (based on the total weight of silver in the ore) and up to about 65% of the gold (based on the total weight of gold in the ore) may in one example be extracted into the aqueous phase, while the remainder is retained within the ore solids.

The pregnant liquid phase is then separated from the solids phase in a conventional form of liquids-solids separator, for example in a conventional counter current decantation circuit, represented schematically at 5.

The liquid phase is treated to recover the valuable metal therefrom. In the example as illustrated it is subjected to electrowinning at 6 and the recovered metal is passed to refining at 7 to yield bullion.

The relatively weak solution remaining after electrowinning at 6 is contacted with activated carbon, preferably by passing it through a series of carbon columns 8 which adsorb substantially all remaining gold and silver from the solution. Loaded carbon from the columns 8 is passed to a carbon stripping station 9, described in more detail later.

The solids phase from the liquids—solids separation 5 is repulped at 11 to a suitably flowable consistency, preferably about 25% to about 45% solids based on the total weight of the slurry, using barren effluent from the carbon columns 8 drawn along line 12. The slurry of solids containing silver or silver and gold residues is subjected to cyanidation and to treatment with activated carbon to adsorb precious metal values. In accordance with the invention, the treatment with activated carbon is conducted at elevated temperature, since as shown in more detail in the Examples below, increased recoveries of silver and gold by adsorption onto activated carbon are achieved when elevated temperatures are employed. Such elevated temperatures may preferably be in the range about 35° C. up to the temperature of decomposition of the reactants such as cyanide but more preferably are about 40° C. to about 100° C., still more preferably about 50° C. to about 100° C.

Heating in accordance with the invention may be applied by heating the pulp before and during contact with the cyanide and with the activated carbon particles. Such heating may be applied preferably by injection of steam into the pulp, or in any other manner conventionally used for heating mineral slurries.

In the example illustrated, the treatment with activated carbon is indicated as being conducted in a circuit 13. As in the CIL or CIP process, a base, preferably lime (CaO or $Ca(OH)_2$), is added to the pulp to achieve a pH preferably in the range about 9 to about 11, more preferably about 10.5 to about 11. The pulp and a soluble cyanide, preferably sodium cyanide, is entered into the first of a series of agitated tanks and is allowed to overflow from each tank and enter the next in the series. Particulate activated carbon taken from a carbon make up stage 14 along a line 15 is added to the final tank of the series. Agitation of the tanks is desirable in order to maintain the solids in suspension and provide good contact between the solution and the pulp solids and carbon particles. At intervals, activated carbon, which is of considerably greater particle size than the mineral particles in the slurry, is separated from the pulp of each tank, for example by sieving, and advanced counterflow to movement of the pulp to the preceding tank. The mixture is maintained at elevated temperature preferably within the ranges discussed above. Preferably, the content of cyanide in the slurry is up to about the equivalent of 3.0 g/L sodium cyanide. The activated carbon particles are maintained in contact with hot ore slurry for a period which is preferably sufficient for equilibrium to be substantially achieved between the ore solids and the carbon, so that transfer of silver and gold from the ore solids to the carbon is substantially complete. The period required to achieve substantial equilibrium depends on the nature of the ore material undergoing treatment and may be determined in any given case by trial and experiment. In the example provided the preferred period is about 96 hours.

The loaded carbon is passed along a line 16 to the carbon stripping stage 9 where it meets loaded carbon from the columns 8. In the stripping stage, the loading on the carbon is stripped with a stripping liquid, preferably a highly alkaline solution which may contain cyanide at elevated temperature. For example, the stripping solution may contain about 1% by weight NaOH and about 0.2% NaCN and may be applied at a temperature of about 100° C. to about 150° C. The stripping solution containing desorbed silver and gold, when present, is passed along line 16 to an electrowinning stage 17 from which the recovered metal is passed to the refining stage 7. Sodium hydroxide and sodium cyanide are added to the barren solution taken from the electrowinning stage 17 in order to regenerate the stripping solution which is passed to the carbon stripping stage along line 18. Alternatively, gold and silver may be recovered from the stripping solution by cementation with powdered zinc.

The spent carbon particles from the carbon stripping stage are passed to a regeneration stage 19 where they are treated in any conventional manner, for example heating at about 650° C. in the absence of oxygen, in order to restore their adsorptive activity. Fresh activated carbon particles may be added at a make up stage 14 to compensate for losses of carbon particles due to attrition or other causes. A part of the activated carbon particles provided in the make up stage 14 is fed to the carbon columns 8 as fresh carbon to be contacted with the incoming solution from the electrowinning stage 6 and the remainder is supplied to the carbon treatment stage 13.

In the example flowsheet, the barren slurry from the carbon treatment stage 13 is passed to a solids/liquids separator 20, for example a thickener. Part of the separated barren liquid phase is returned along line 3 to the pulping stage 2, and part is passed for cyanide recovery. The barren solids separated at stage 20 are washed with water and are subjected to a further solids/liquids separator 21, which again may be a thickener. The aqueous washings liquid phase is returned to stage 20, while the solids are sent to cyanide destruction and thence to tailings.

Various modifications to the process described above in detail with reference to the drawings may be made. For example, the treatment of the pulp of leached ore solids with activated carbon carried out in stage 13 may be conducted without the addition of cyanide. In such case the procedure as described above in detail with reference to the drawings is carried out except the pulp obtained from the repulping stage 11 is entered into the series of agitated tanks in countercurrent contact with the carbon particles without the addition of cyanide such as sodium cyanide to the pulp.

In a further modification, which is advantageous when the ore material does not have a high content of precious metal such as silver, the procedure described above in detail with reference to the drawings is conducted except stages 2, 4, 5, 6 and 8 are omitted. The ore solids are pulped in stage 11 with a portion of the barren liquid taken from stage 20. A base, such as lime is added to bring the pH to about 9 to about 11, preferably about 10.5 to 11, and after addition of cyanide, preferably sufficient to achieve a concentration of cyanide ion equivalent to up to about 3.0 g/L sodium cyanide, the cyanided pulp is treated with activated carbon in circuit 13, preferably in multiple stages as described above with countercurrent flow of the activated carbon and of the cyanided pulp. The pulp is maintained throughout its treatment with activated carbon at elevated temperature which should be in the range up to about 70° C., more preferably about 40° C. to about 70° C. and still more preferably about 50° C. to about 70° C. in order to obtain increased capture of the precious metal onto the carbon under equilibrium conditions without incurring excessively high energy costs. The remainder of this modified process is as described above in detail with reference to the accompanying drawings.

The above description provides ample information to enable one of ordinary skill in the art to carry out the process of the invention. For the avoidance of doubt however, some detailed non-limiting Examples will be given.

Examples 1 to 5

Varied residues from pressure oxidation of gold and silver ores containing graphite were obtained as described in the above-mentioned co-pending application Ser. No. 07/885,761.

Samples of these pressure-oxidized ores were leached for 24 hours with various concentrations of sodium cyanide solution at various temperatures in a slurry which in each case contained 25% solids by weight based on the total weight of the slurry.

The gold and silver contents of the feed (pressure oxidized ore) ores were assayed as well as the gold and silver contents of the discharge or solids residue remaining after cyanide leaching. The contents of gold and silver dissolved in the leach solution were also assayed. The extraction of gold and silver was calculated as % based on analysis of feed and discharge solids.

The leaching was conducted on a further sample in the presence of 300 kg/t activated carbon. An increased extraction of gold and silver was noted as indicated by reduced weights of gold and silver remaining on the solids residue after cyanide leaching. This indicated preg robbing was taking place. The results are indicated in Table 1.

TABLE 1

| Cyanidation of Pressure Leach Residue | | | | | | | | | | | |
|---|---|---|---|---|---|---|---|---|---|---|---|
| Example | Carbon | Temp. | NaCN | Feed g/t | | Discharge g/t | | Solution mg/L | | Extraction % | |
| No | kg/t | °C. | g/L | Au | Ag | Au | Ag | Au | Ag | Au | Ag |
| 1 | 300 | 25 | 5 | 96 | 3654 | 17.7 | 411 | — | — | 81.6 | 88.8 |
| 2 | 0 | 25 | 5 | 99.4 | 3657 | 42.3 | 383 | 14 | 920 | 57.5 | 89.5 |
| 3 | 0 | 35 | 1 | 99.4 | 3657 | 38.8 | 406 | 17.2 | 982 | 61.0 | 88.9 |
| 4 | 0 | 35 | 2 | 99.4 | 3657 | 34.6 | 359 | 16.3 | 973 | 65.2 | 90.2 |
| 5 | 0 | 35 | 5 | 99.4 | 3657 | 36.2 | 372 | 17.2 | 1053 | 63.6 | 89.9 |

Example 6–11

A pressure oxidized ore was cyanide leached as described in Examples 2 to 5 above (in the absence of activated carbon). A cyanide leach solids residue was separated.

The residue contained 51.2 g/t gold and 494 g/t silver.

Samples of this cyanide leach residue were mixed with 10 to 100 kg activated carbon/tonne of leach residue and were agitated in a 0.5 g/L sodium cyanide solution at various temperatures. The resulting slurry contained 25% leach residue solids.

After extraction periods of 48 hours (Examples 6 to 11) and 96 hours (indicated in the Table 3 by the same Example numbers with "a" suffixes), the activated carbon, the solids and the solution were assayed for gold and silver contents. The percentage by weight extracted onto the activated carbon, based on the weight originally present in the cyanide leach residue, was calculated (CX%) as well as the percentage by weight extracted in the initial cyanide leach together with activated carbon extraction, based on the weight of gold and silver present in the original pressure oxidized ore (extraction total %).

The results were as indicated in Table 2.

TABLE 2

| Extraction of Au and Ag from Cyanide Leach Residue | | | | | | | | | | | | | |
|---|---|---|---|---|---|---|---|---|---|---|---|---|---|
| Example | Temp. | Carbon | Time | Carbon g/t | | Residue g/t | | Solution mg/L | | Extraction CX % | | Extraction Total % | |
| No. | C. | kg/t | h | Au | Ag | Au | Ag | Au | Ag | Au | Ag | Au | Ag |
| (Feed) | — | — | — | — | — | 51.2 | 494 | — | — | — | — | | |
| 6 | 25 | 20 | 48 | 1044 | 6445 | 29.3 | 353 | 0.025 | 2.37 | 41.5 | 27.2 | 68.6 | 90.2 |
| 6a | 25 | 20 | 96 | 1164 | 6236 | 25.2 | 349 | 0.042 | 2.03 | 48.0 | 27.0 | 72.1 | 90.1 |
| 7 | 25 | 100 | 48 | 232 | 1431 | 27.8 | 353 | 0.009 | 0.18 | 44.4 | 27.9 | 70.2 | 90.3 |
| 7a | 25 | 100 | 96 | 236 | 1254 | 23.8 | 347 | 0.010 | 0.40 | 52.5 | 29.0 | 74.5 | 90.4 |
| 8 | 45 | 10 | 48 | 2712 | 9580 | 19.4 | 319 | 0.66 | 21.0 | 60.5 | 34.9 | 78.8 | 91.2 |
| 8a | 45 | 10 | 96 | 3024 | 9331 | 16.4 | 317 | 0.61 | 22.4 | 70.9 | 36.9 | 84.4 | 91.5 |
| 9 | 45 | 50 | 48 | 682 | 3420 | 16.6 | 311 | 0.10 | 3.61 | 67.3 | 36.8 | 82.5 | 91.5 |
| 9a | 45 | 50 | 96 | 710 | 3159 | 12.3 | 307 | 0.045 | 3.29 | 75.6 | 36.7 | 86.9 | 91.5 |
| 10 | 55 | 10 | 48 | 2228 | 7281 | 16.1 | 343 | | | 65.9 | 33.4 | 81.7 | 91.0 |
| 10a | 55 | 10 | 96 | 2227 | 8226 | 14.0 | 317 | | | 74.6 | 41.8 | 86.4 | 92.1 |
| 11 | 55 | 50 | 48 | 686 | 2898 | 13.4 | 299 | | | 72.8 | 34.7 | 85.4 | 91.2 |
| 11a | 55 | 50 | 96 | 667 | 3118 | 10.9 | 297 | | | 77.1 | 37.3 | 87.7 | 91.5 |

After 96 hours of treatment with the activated carbon at elevated temperature, extraction of the gold and silver onto the activated carbon had substantially reached equilibrium.

At equal rates of addition of carbon, significantly greater solutions of precious metal onto the carbon were achieved with increasing temperature, as indicated by, for example, the assays of the residue. Note, for example, the residue g/t gold in Example 10a (14.0) as compared with Example 8 (16.4) or the residue g/t silver in Example 11a (297) as compared with Example 9a (307).

Examples 12–17

The procedure as described above in Examples 6–11 were repeated with a second sample (feed) of a cyanide leached solids residue obtained as described under Examples 2 to 5. The results, as indicated in Table 3, showed a pronounced increase in silver extraction when conducted at 55° C. as compared with 45° C.

TABLE 3

Extraction of Au and Ag from Cyanide Leach Residue

| Example No. | Temp. C. | Carbon kg/t | Time h | Carbon g/t Au | Carbon g/t Ag | Residue g/t Au | Residue g/t Ag | Solution mg/L Au | Solution mg/L Ag | Extraction CX % Au | Extraction CX % Ag | Extraction Total % Au | Extraction Total % Ag |
|---|---|---|---|---|---|---|---|---|---|---|---|---|---|
| (Feed) | — | — | — | — | — | 24.5 | 483 | — | — | — | — | — | — |
| 12 | 45 | 10 | 48 | 1372 | 9484 | 9.5 | 301 | 0.20 | 23.5 | 62.5 | 37.8 | 82.2 | 87.6 |
| 12a | 45 | 10 | 96 | 1559 | 9392 | 5.7 | 275 | 0.39 | 22.3 | 76.4 | 37.8 | 88.8 | 87.6 |
| 13 | 45 | 50 | 48 | 324 | 3425 | 8.5 | 287 | 0.026 | 2.81 | 66.9 | 39.9 | 84.2 | 88.0 |
| 13a | 45 | 50 | 96 | 364 | 2673 | 5.0 | 268 | 0.028 | 4.06 | 79.0 | 46.4 | 90.0 | 89.3 |
| 14 | 45 | 200 | 48 | 94 | 910 | 6.6 | 280 | 0.006 | 0.62 | 74.4 | 40.2 | 87.8 | 88.1 |
| 14a | 45 | 200 | 96 | 106 | 1024 | 3.5 | 266 | 0.005 | 0.43 | 86.5 | 45.0 | 93.6 | 89.1 |
| 15 | 55 | 10 | 48 | 1521 | 10217 | 6.6 | 261 | 0.48 | 31.4 | 74.7 | 46.3 | 88.0 | 89.3 |
| 15a | 55 | 10 | 96 | 1434 | 10151 | 5.7 | 183 | 0.72 | 45.8 | 78.4 | 60.7 | 89.7 | 92.2 |
| 16 | 55 | 50 | 48 | 409 | 3831 | 5.4 | 252 | 0.048 | 4.68 | 79.5 | 46.2 | 90.2 | 89.3 |
| 16a | 55 | 50 | 96 | 399 | 4818 | 3.9 | 180 | 0.090 | 11.8 | 85.2 | 62.6 | 93.0 | 92.6 |
| 17 | 55 | 200 | 48 | 104 | 1139 | 5.2 | 252 | 0.008 | 1.24 | 80.1 | 48.4 | 90.5 | 89.7 |
| 17a | 55 | 200 | 96 | 106 | 1363 | 3.4 | 192 | 0.012 | 1.80 | 86.9 | 60.7 | 93.8 | 92.2 |

EXAMPLES 18-20

The results of Tables 2 and 3 were all obtained at 0.5 g/L sodium cyanide. Table 4 provides the results obtained with other cyanide concentrations, and wherein the procedure of Examples 6-11 is repeated with the same sample (feed) of a cyanide leached solids residue.

TABLE 4

Effect of Sodium Cyanide on the Extractionof Au and Ag

| Example No. | Temp. C. | Carbon kg/t | NaCN g/L | Time h | Carbon g/t Au | Carbon g/t Ag | Residue g/t Au | Residue g/t Ag | Solution mg/L Au | Solution mg/L Ag | Extraction CX % Au | Extraction CX % Ag | Extraction Total % Au | Extraction Total % Ag |
|---|---|---|---|---|---|---|---|---|---|---|---|---|---|---|
| (Feed) | — | — | — | — | — | — | 5.12 | 494 | — | — | — | — | — | — |
| 18 | 45 | 50 | 0 | 48 | 660 | 1412 | 18.2 | 416 | 0.012 | 0.31 | 63.0 | 14.0 | 80.2 | 88.4 |
| 18a | 45 | 50 | 0 | 96 | 716 | 1157 | 15.2 | 434 | 0.021 | 0.26 | 69.9 | 11.6 | 83.7 | 88.1 |
| 19 | 45 | 50 | 0.5 | 48 | 682 | 3420 | 16.6 | 311 | 0.10 | 3.61 | 67.3 | 36.8 | 82.5 | 91.5 |
| 19a | 45 | 50 | 0.5 | 96 | 710 | 3159 | 12.3 | 307 | 0.045 | 3.19 | 75.6 | 36.7 | 86.9 | 91.5 |
| 20 | 45 | 50 | 2.0 | 48 | 722 | 3430 | 14.4 | 305 | 0.086 | 4.78 | 71.9 | 38.2 | 84.9 | 91.7 |

As seen in Table 4, the best comparative results were obtained at 2.0 g/L sodium cyanide, the highest concentration tested. As will be seen from Example 18a, however, substantial capture of precious metal from the cyanide leach residue on the activated carbon was achieved even in the absence of cyanide.

We claim:

1. A process for recovery of precious metal, wherein said precious metal is selected from the group consisting of silver and a mixture of gold and silver, from an ore material of said precious metal containing naturally occurring active carbonaceous material that adsorbs previous metal from solution thereof, comprising forming a slurry of the ore material in cyanide solution and dissolving a portion of said precious metal as cyanide compounds thereof in said solution, conducting a solids-liquids separation on the slurry to separate a solution containing said portion of said precious metal from a solids residue containing the remainder of said precious metal, subjecting said solution to precious metal recovery to recover said portion of said precious metal therefrom, forming a second slurry of said solids residue in a liquid compatible therewith, mixing activated carbon therewith and maintaining the mixture at a temperature of from about 35° C. to about 100° C. whereby a substantial portion of the remainder of said precious metal is captured on said activated carbon, separating said activated carbon having said precious metal thereon from said second slurry and stripping said activated carbon to liberate the precious metal captured thereon.

2. A process as claimed in claim 1 wherein said temperature is about 40° C. to about 100° C.

3. A process as claimed in claim 2 wherein said temperature is about 50° C. to about 100° C.

4. A process as claimed in claim 1 wherein said ore material contains at least about 800 g/t silver.

5. A process as claimed in claim 1 wherein the liquid in which the second slurry is formed contains a concentration of cyanide ion equivalent to up to about 3.0 g/L sodium cyanide.

6. A process as claimed in claim 1 wherein said residue is agitated with a cyanide solution simultaneously with mixing said second slurry with said activated carbon.

7. A process for recovery of precious metal, wherein said precious metal is selected from the group consisting of gold, silver and mixtures thereof, from an ore material of said precious metal containing naturally occurring active carbonaceous material that adsorbs precious metal from solution, comprising reacting the ore material with cyanide solution to provide a slurry containing the precious metal in solubilized form, mixing activated carbon with said slurry maintained at elevated temperature in the range about 40° C. up to about 70° C. and capturing said precious metal by adsorption on the activated carbon, separating the activated carbon from the slurry and stripping the separated activated carbon to liberate precious metal therefrom, and wherein said slurry is maintained at pH about 9 to about 11.

8. A process as claimed in claim 7 wherein said temperature is about 50° C. to about 70° C.

9. A process as claimed in claim 7 wherein said pH is about 10.5 to about 11.

10. A process as claimed in claim 7 wherein the slurry contains up to about the equivalent of 3.0 g/L sodium cyanide.

* * * * *

UNITED STATES PATENT AND TRADEMARK OFFICE

CERTIFICATE OF CORRECTION

PATENT NO. : 5,320,720

DATED : June 14, 1994

INVENTOR(S) : Hayden et al.

It is certified that error appears in the above-indentified patent and that said Letters Patent is hereby corrected as shown below:

On the title page, item [54], change "PRECISOUS" to --PRECIOUS--.

Signed and Sealed this

Twenty-fifth Day of October, 1994

*Attest:*

Bruce Lehman

BRUCE LEHMAN

*Attesting Officer*

*Commissioner of Patents and Trademarks*